US005148687A

United States Patent [19]

Tamei et al.

[11] Patent Number: 5,148,687

[45] Date of Patent: Sep. 22, 1992

[54] COOLING APPARATUS FOR BULK MATERIAL

[75] Inventors: Akira Tamei; Katsuhiro Oshio, both of Nara; Tadaaki Sumoto, Gose; Yoshihisa Tozawa, Nara; Takashi Nakahara, Itami; Masaru Nishimoto, Daito; Yasuhiko Yasui, Ibaraki, all of Japan

[73] Assignee: Hitachi Zosen Corporation, Osaka, Japan

[21] Appl. No.: 703,396

[22] Filed: May 21, 1991

[30] Foreign Application Priority Data

Sep. 28, 1990 [JP] Japan ..... 2-102480[U]
Sep. 28, 1990 [JP] Japan ..... 2-260807
Sep. 29, 1990 [JP] Japan ..... 2-102596[U]

[51] Int. Cl.[5] ..... F25D 23/02
[52] U.S. Cl. ..... 62/266
[58] Field of Search ..... 62/266, 381; 34/233; 432/77; 277/135

[56] References Cited

U.S. PATENT DOCUMENTS 3,955,484 5/1976 Hirahama et al. ..... 98/115.4
4,026,200 5/1977 Lindqvist ..... 98/115.4
4,426,088 1/1984 Ernst ..... 277/135

FOREIGN PATENT DOCUMENTS 25277 7/1989 Japan .

*Primary Examiner*—Ronald C. Capossela
*Attorney, Agent, or Firm*—Joseph W. Farley

[57] ABSTRACT

The invention relates to a cooling apparatus for hot bulk material, such as sintered ore. Gaps are defined between respective lower ends of side wall portions of a moveable annular air duct and respective upper ends of side wall portions of a stationary annular air duct, which gaps communicate the air passage in the stationary annular air duct with annular water seal chambers. First seal plates are disposed at respective upper ends of the side wall portions of the stationary annular air duct in relation to respective lower ends of the side wall portions of the moveable annular air duct. Second seal plates are disposed at respective lower ends of the side wall portions of the movable annular air duct. Labyrinth seals are formed by the first seal plates, the side wall portions of the moveable annular air duct, and the second seal plates in combination. This seal arrangement is entirely different from the conventional seal structure which involves sliding contact of seal members with other surfaces. Therefore, the seals are not subject to abrasion and this provides greater ease of maintenance and checking.

5 Claims, 7 Drawing Sheets

COOLING APPARATUS FOR BULK MATERIAL

FIELD OF THE INVENTION

The present invention relates to a cooling apparatus for bulk material.

BACKGROUND OF THE INVENTION

In a conventional cooling apparatus for hot bulk material, e.g., sintered ore, the sintered ore is moved along a circular path and, meanwhile, cooling air is introduced for flowing upward from below the path to cool the sintered ore.

A typical example of this type of cooling apparatus is described in Japanese Utility Model Publication No. 1-25277.

This cooling apparatus includes a carrier assembly movable along a circular path which comprises circular side walls interconnected by a connecting beam, and a trough disposed at a bottom portion between the side walls for loading a mass of sintered ore thereon. Cooling air is supplied into an air box provided in the trough. For supplying cooling air into the air box, there is provided a stationary cooling duct extending along the circular path and, on the carrier assembly side, there is provided a trough cooling duct. The gap between the stationary cooling duct and the trough cooling duct is sealed by water sealing.

At a supply/discharge station for supply and discharge of sintered ore formed at a location on the circular path, the trough cooling duct is likely to communicate with the atmosphere and thus allow cooling air to escape from the trough cooling duct. In order to prevent such trouble, there is provided a dead plate for closing an air passage formed in the stationary cooling duct at a portion adjacent the station. Also, there is provided a rubber seal for closing the clearance between the through cooling duct and the dead plate. In other cooling areas on the circular path than at the supply/discharge station, there is also provided a rubber seal between a side plate portion of the stationary cooling duct and a cover of the trough cooling duct in order to prevent cooling air from flowing to the supply/discharge station via the water seal chamber.

With such known arrangement, however, the rubber seal used for closing the gap between the stationary cooling duct and the trough cooling duct is subject to considerable abrasion, which fact necessitates frequent rubber seal replacement. This poses the problem that necessary maintenance is very troublesome.

SUMMARY OF THE INVENTION

Accordingly, it is a primary object of the invention to provide a cooling apparatus for bulk material which eliminates the above stated problem with the prior art and affords easy maintenance.

In order to accomplish this object, according to the present invention there is provided a cooling apparatus for bulk material wherein masses of hot bulk material loaded on a plurality of troughs movable along a circular travel path are cooled by cooling air supplied from air boxes positioned below respective surfaces on which the masses of hot bulk material are placed, said cooling apparatus comprising:

a stationary annular air duct arranged in a circular fashion along said travel path and having an inner side wall portion located on the inner peripheral side and an outer side wall portion located on the outer peripheral side, said inner and outer side wall portions defining an air passage therebetween, said stationary annular air duct being open at the top;

annular water seal chambers provided on respective outer sides of said inner and outer side wall portions;

a movable annular air duct movable integrally with said troughs and capable of covering the opening of said stationary annular air duct from above, said movable annular air duct having an inner peripheral side wall portion and an outer peripheral side wall portion, said side wall portions having their respective lower ends positioned in corresponding relation to respective upper ends of the inner and outer side wall portions of said stationary annular air duct;

a plurality of connecting ducts for communicating the movable annular air duct with respective air boxes of said troughs;

seal plate members depending respectively from the two side wall portions of said movable annular air duct for entry into the water in said annular water seal chambers;

gaps defined between respective lower ends of the side wall portions of said movable annular air duct and respective upper ends of the side wall portions of said stationary annular air duct which communicate the air passage within the stationary annular air duct with said annular water seal chambers;

first seal plates provided at respective upper ends of the side wall portions of said stationary annular air duct in relation to respective lower ends of the side wall portions of said movable annular air duct so as to minimize said gaps; and second seal plates provided at respective lower ends of the side wall portions of said movable annular air duct to form labyrinth seals in cooperation with said first seal plates.

According to such arrangement, the gaps at connections between the stationary annular air duct and the movable annular air duct are sealed through a labyrinth effect achieved by the combination of the first seal plates, side wall portions of the movable air duct, and the second seal plates, and thus escape of cooling air can be effectively inhibited. Therefore, provision of such a seal structure as a conventional rubber seal, which requires sliding contact with associated surfaces, is no longer necessary. The arrangement involves no abrasion possibility and thus provides greater ease of maintenance and checking.

DESCRIPTION OF THE PREFERRED EMBODIMENTS

One embodiment of the invention will now be described with reference to FIGS. 1 through 5.

Figure 1:
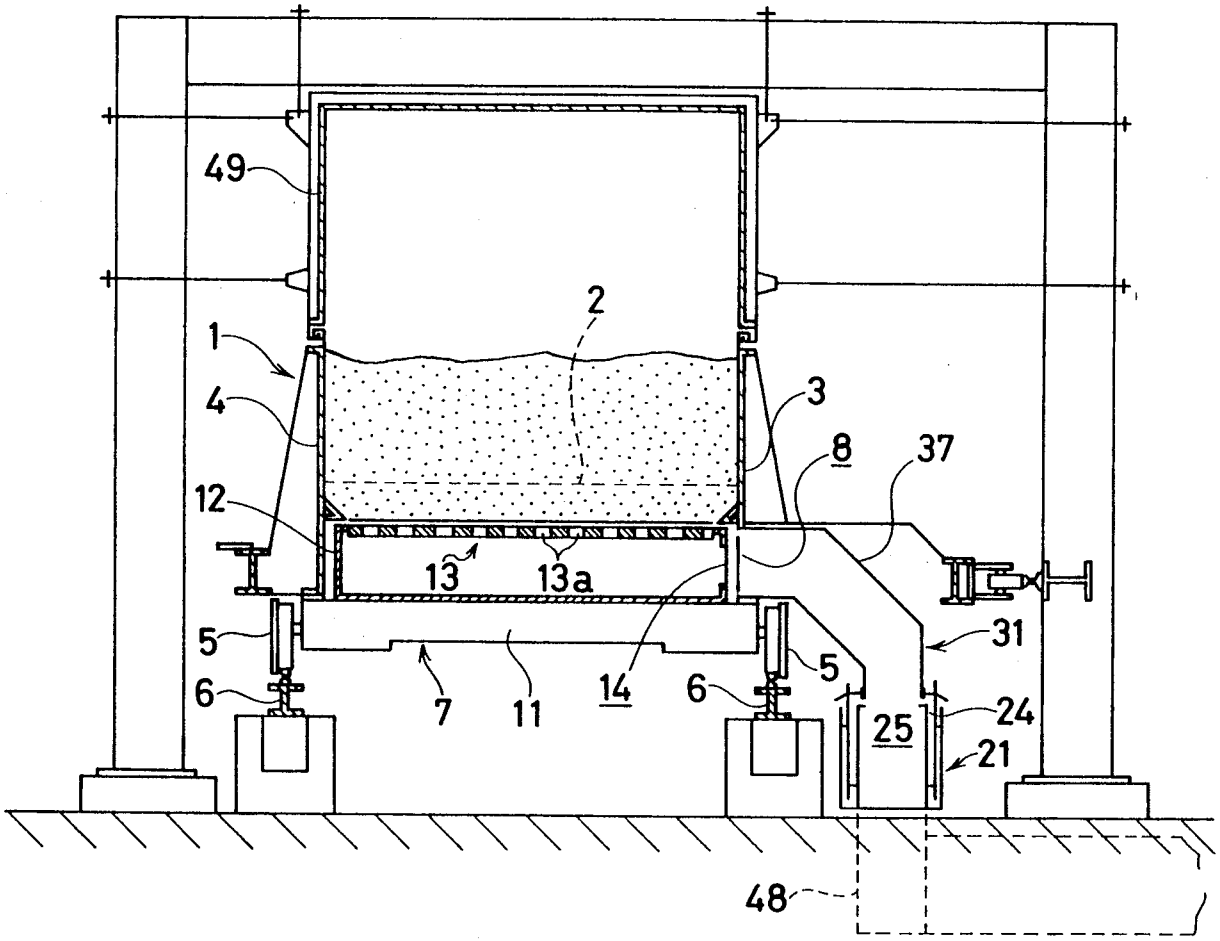
FIG. 1 is a sectional view showing a cooling apparatus for bulk material representing one embodiment of the invention.
Figure 2:
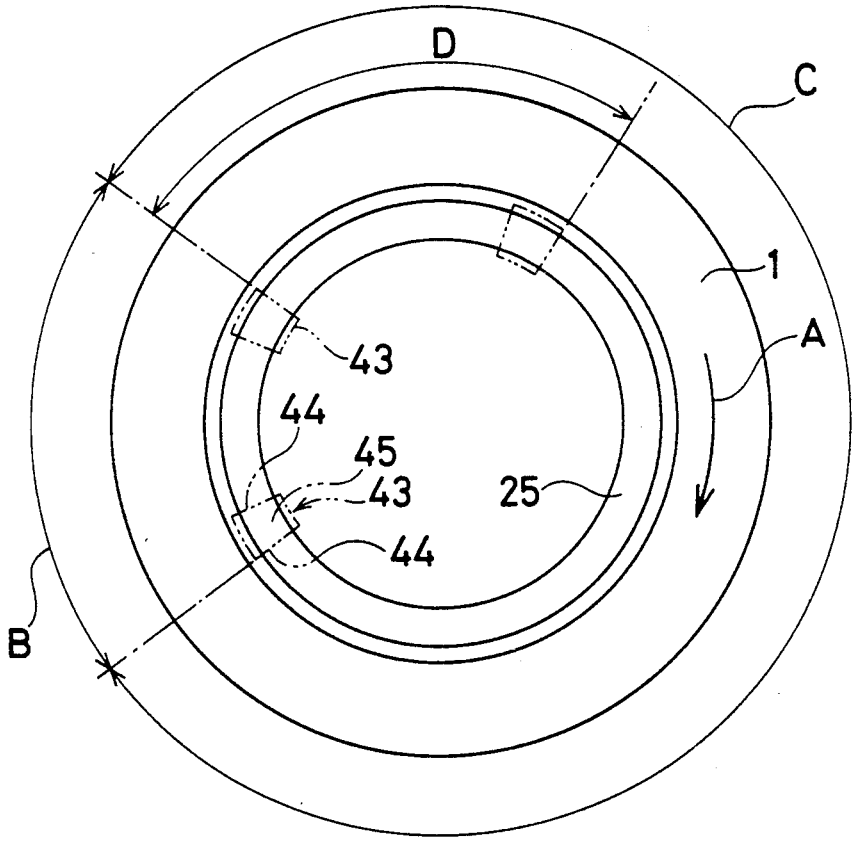
FIG. 2 is a schematic general view in plan of the cooling apparatus.

In FIGS. 1 and 2, numeral 1 designates a carrier assembly which is movable along a circular travel path A. The carrier assembly 1 is adapted to transport hot bulk material or sintered ore from a supply station located at a portion of the travel path A to a discharge station located at another portion of the travel path A so as to cause the sintered ore to be cooled by cooling air while the sintered ore is so transported. The carrier assembly 1 comprises an inner circular side wall 3 and an outer circular side wall 4 which are interconnected by a connecting beam 2, and a plurality of troughs 7 disposed at a bottom portion between the circular side walls 3, 4 and movable through guide wheels 5 on guide rails 6 provided in a circular fashion.

Each trough 7 comprises a trough body 11 having guide wheels 5 at both sides, and an air box 12 disposed on the top of the trough body 11. The top side of the air box 12 is comprised of an air plate 13 formed with a multiplicity of air holes 13*a*. The air box 12 has an opening 14 formed on the inner peripheral side thereof.

Figure 3:
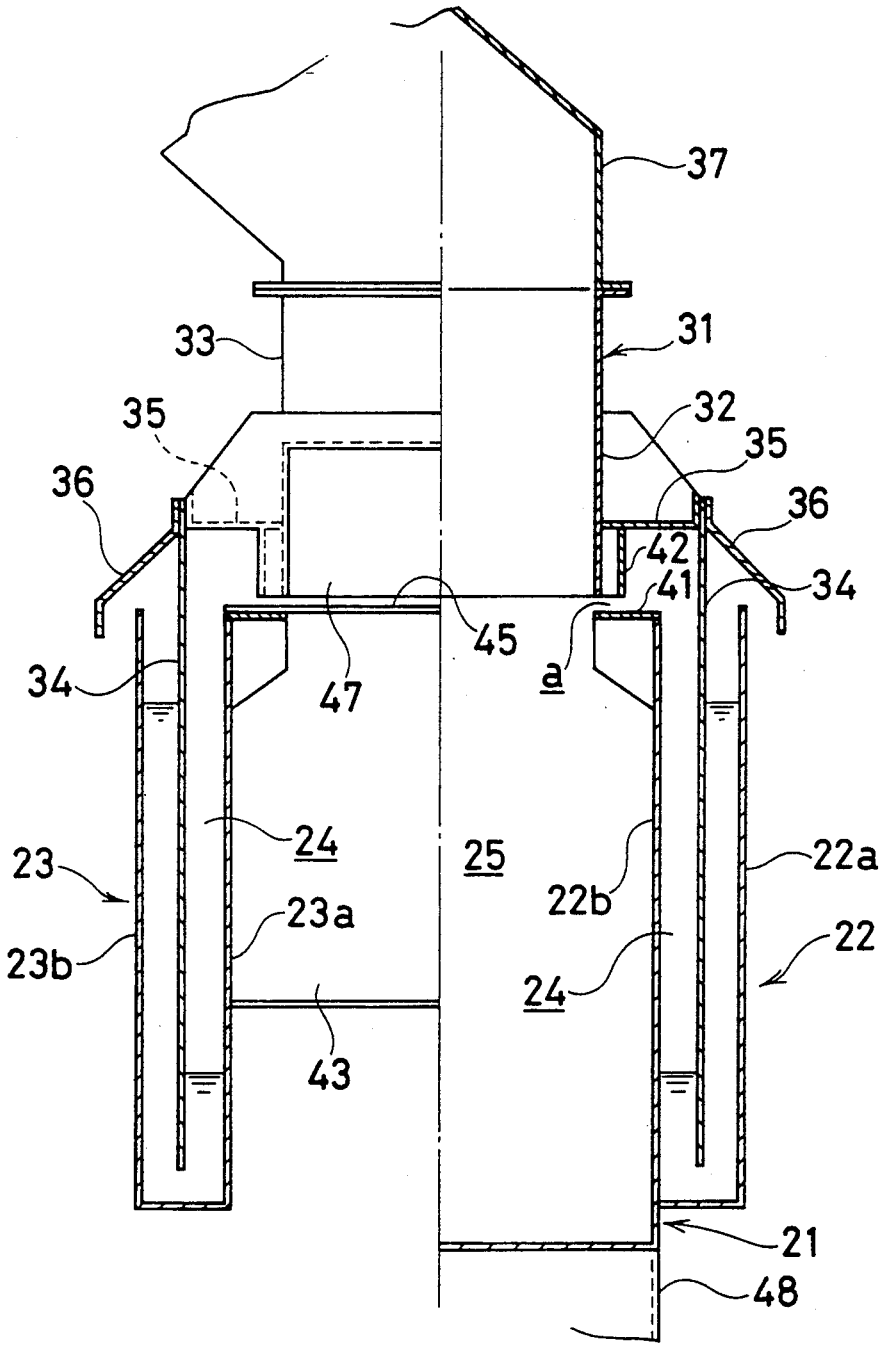
FIG. 3 is a partially cutaway view of a portion of the cooling apparatus.
Figure 4:
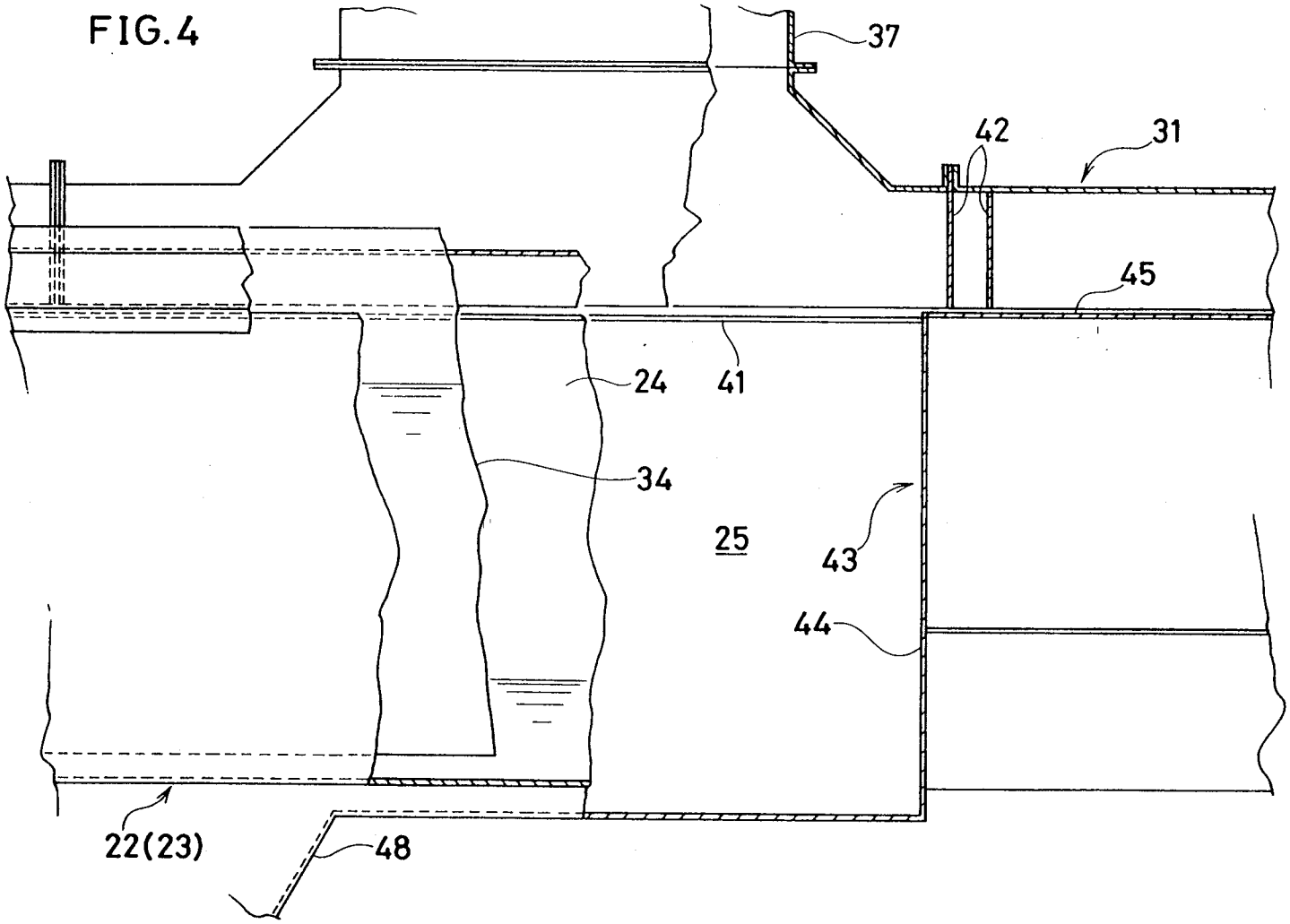
FIG. 4 is a partially cutaway side view of the portion shown in FIG. 3.
Figure 5:
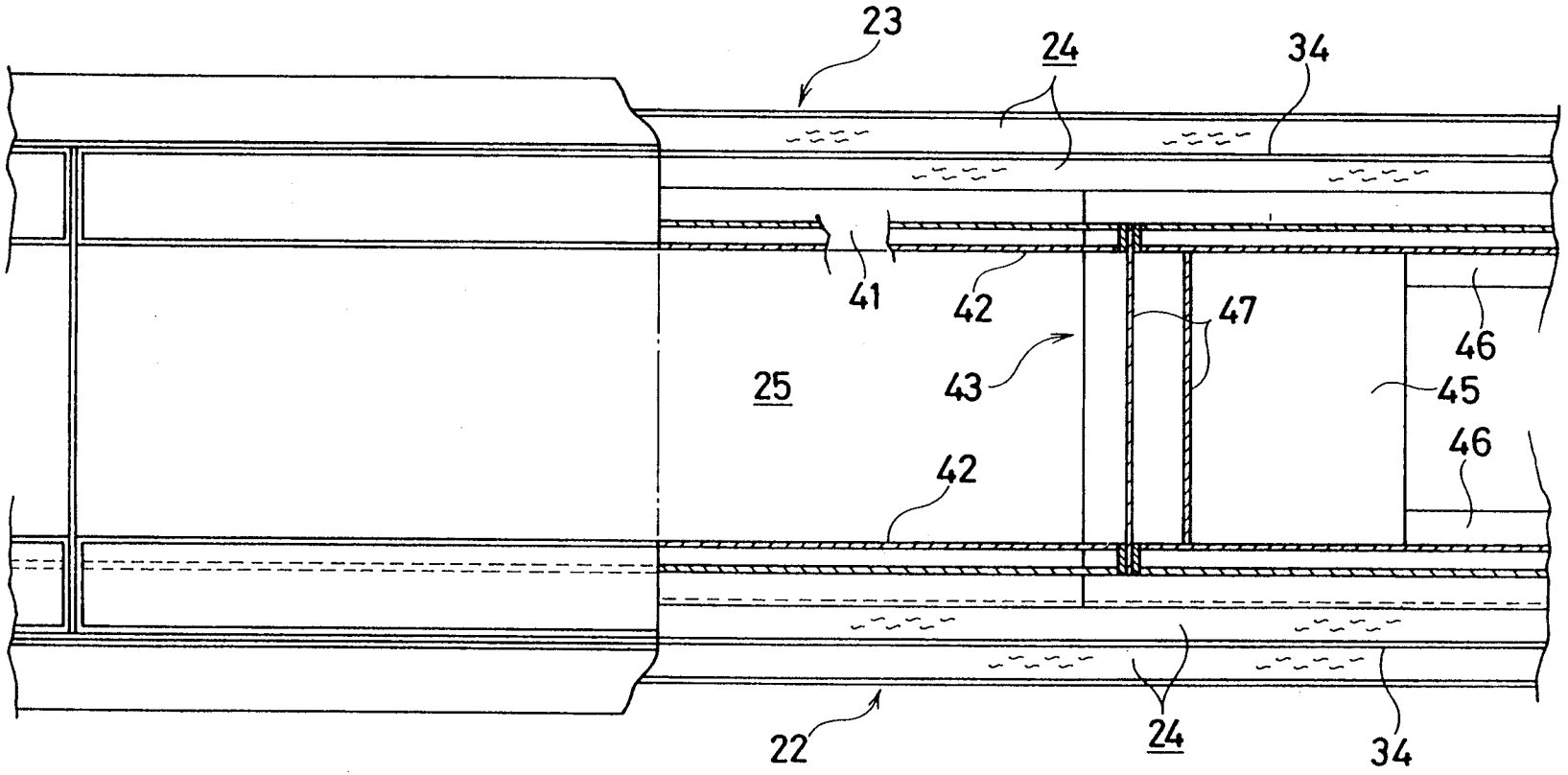
FIG. 5 is a partially cutaway plan view of the portion shown in FIG. 4.

Radially inwardly from the carrier assembly 1 there is provided a stationary annular air duct 21 which extends along the travel path A for the carrier assembly 1. The stationary annular air duct 21 is dispsed at a level lower than the troughs 7 and is open at its top, and as FIGS. 3 to 5 show in detail, it has inner and outer side wall portions 22, 23 which are each formed with a top-open annular water seal chamber 24. The side wall portions 22, 23 of the stationary annular air duct 21 are of a double wall construction such that the respective side wall portion 22, 23 has an inner peripheral plate 22*a*, 23*a* and an outer peripheral plate 22*b*, 23*b*.

A movable annular air duct 31 adapted to cover the top of the entire stationary annular air duct 21 is disposed at a position below the inner circular side wall 3 at the circumferentially inner side thereof, the air duct 31 being attached to the inner circular side wall 3 by means of a plurality of connecting ducts 37. The movable annular air duct 31 and the stationary annular air duct 21 are sealed through water sealing. More specifically, seal plates 34 depend respectively from the side wall portions 32, 33 of the movable annular air duct 31 for entry into the two annular water seal chambers 24. Shown by 35 is a mounting flange. Each seal plate 34 is so constructed that its lower end is positioned under water in the respective annular water seal chamber 24. A cover plate 36 extends obliquely downward from the top end of each seal plate 34 at the outer side thereof for covering the top of the respective annular water seal chamber 24 at the outer side thereof.

As FIG. 1 shows, each connecting duct 37 communicates the movable annular air duct 31 with an opening 8 formed in the inner circular side wall 3 in corresponding relation to each respective trough 7. Through the connecting ducts 37 the interior of respective air boxes 12 of the troughs 7 is held in communication with an air passage 25 formed in the stationary annular air duct 21, so that cooling air can be supplied through the air passage 25 into individual air boxes 25.

As FIG. 2 shows, at an intermediate location on the travel path A for the carrier assembly 1 there is provided a supply/discharge station B for supply and discharge of sintered ore, at which station B the air box 12 of each trough 7 is in communication with the atmosphere.

Therefore, a certain arrangement is made for preventing possible escape of cooling air from this portion of the apparatus. More specifically, as FIG. 3 shows, the lower opening of the movable annular air duct 31 is formed narrower than the width of the air passage 25 in the stationary annular air duct 21. The lower ends of the side wall portions 32, 33 of the movable annular air duct 31 are positioned slightly above the upper ends of the side wall portions 22, 23 of the stationary annular air duct 21. At respective upper ends of the inner peripheral plate 23*a* and the outer peripheral plate 22*b* which respctively define annular water seal chambers 24 of the stationary annular air duct 21, there are provided first seal plates 41 for reducing the gaps a relative to the side wall portions 32, 33 of the movable annular air duct 31 to the narrowest possible extent, which seal plates 41 extend along substantially the entire length of the travel path A. The gaps a each constitute a connection between the air passage and one of the annular water seal chambers. At respective lower ends of the side wall portions 32, 33 of the movable annular air duct 31, externally thereof, there are provided second seal plates 42 for forming labyrinth seals in cooperation with the lower ends and the first seal plates 41, which second seal plates 42 extend above the first seal plates 41 and along the entire length of the travel path A.

As FIGS. 2 to 5 show, at front and rear end positions of the supply/discharge station B for sintered ore, there are disposed dead plates 43 for closing the air passage 25 in the stationary annular air duct 21. Each of the dead plates 43 comprises a pair of blocking side plates 44 for cross-sectionally blocking the air passage 25 which are spaced a predetermined distance apart in the longitudinal direction of the travel path A, and a top side blocking plate 45 extending between the upper ends of the blocking side plates 44. As FIG. 3 shows, the heightwise position of the top side blocking plate 45 is set so that the upper surface of the top side blocking plate 45 is positioned higher than the upper surface of each first seal plate 41, whereby possible leakage of cooling air at the supply/discharge station B may be minimized.

As FIG. 5 shows, communication gaps a between the dead plates 43 disposed at the front and rear ends of the supply/discharge station B is sealed by third seal plates 46 disposed even with the top side blocking plate 45 of the dead plate 43.

As FIGS. 4 and 5 show, each portion of the movable annular air duct 31 between adjacent connecting ducts 37 provided in relation to individual troughs 7 is provided with partition plates 47 for blocking that portion of the stationary annular air duct 21 which is located above the air passage 25, in the direction of movement of the troughs 7.

As FIGS. 1, 3 and 4 show, a cooling air supply duct 48 is connected to the stationary annular air duct 21 at a predetermined location. Further, as FIG. 1 shows, a stationary hood 49 for recovery of air heated up as a result of cooling sintered ore is disposed above the circular side walls 3, 4, which stationary hood 49 extends along the entire length of the travel path A.

Nextly, the cooling function of the apparatus will be explained.

In that portion of the travel path A which is indicated as a cooling region C, cooling air supplied from the cooling air supply duct 48 into the air passage 25 of the stationary annular air duct 21 passes through each connecting duct 37 for entry into the air box 12 of the corresponding trough 7. The cooling air is then guided through the air plate 13 to the trough 7 to cool the sintered ore. Subsequently, the cooling air is discharged through the stationary hood 49 above the trough 7.

The cooling air which has entered the air passage 25 of the stationary annular air duct 21 in the cooling region C is baffled by the dead plates 43, being thus prevented from flowing into the supply/discharge station B. Therefore, the cooling air is prevented from escaping into the atmosphere through the supply/discharge station B.

At the communication gaps a between the air passage 25 and the annular water seal portions 24 in the cooling region C, flow out of cooling air can be effectively prevented by virtue of the labyrinth effect provided by the first seal plates 41, side wall portions 32, 33, and second seal plates 42. If any outflow should occur, any outward leak of the air is positively prevented by the water seal arrangement.

At the supply/discharge station B, the top side blocking plate 45 which constitutes the upper surface of each dead plate 43 is positioned above the first seal plates 41. This insures effective prevention of cooling air outflow all the more.

The movable annular air duct 31 is positioned lower than the troughs 7 and is connected to the carrier assembly 1 through the intermediary of the connecting ducts 37. This affords greater ease of replacement even if any damage is caused to the circular side walls 3, 4 and replacement is required. Maintenance and checking of the annular water seal chambers, which must be carried out from above, can be advantageously performed, because the annular water sealing chambers 24 are positioned lower than the troughs 7.

As FIG. 2 shows, a heat recovery section D for recovering heat from the air heated up to a high temperature as a result of sintered ore cooling is provided behind the supply/discharge station B on the transport path A for the carrier assembly 1. A heat recovering device not shown is disposed at the heat recovery section D so that hot air is allowed to return from the heat recovery device to the stationary annular air duct 21.

If the hot air should enter the annular water seal chambers 24 and heat up the water in the chambers to boiling, considerable inconvenience would be caused. In order to prevent such trouble, fourth seal plates not shown are provided above the first seal plates 41 in the heat recovery section D so that communication gaps a between respective lower ends of the side wall portions 32, 33 of the movable annular air duct 31 and the first seal plates 41 are made narrower. For example, the fourth seal plates may be disposed at same height and spaced same distance as the third seal plates 46. At the border between the heat recovery section D and the cooling region C having no heat recovery section D, a blocking plate of a similar construction to the top side blocking plate 45 of the dead plate 43 is disposed so that no gas mixing may occur between the heat recovery section D and the cooling region C having no heat recovery section D.

Figure 6:
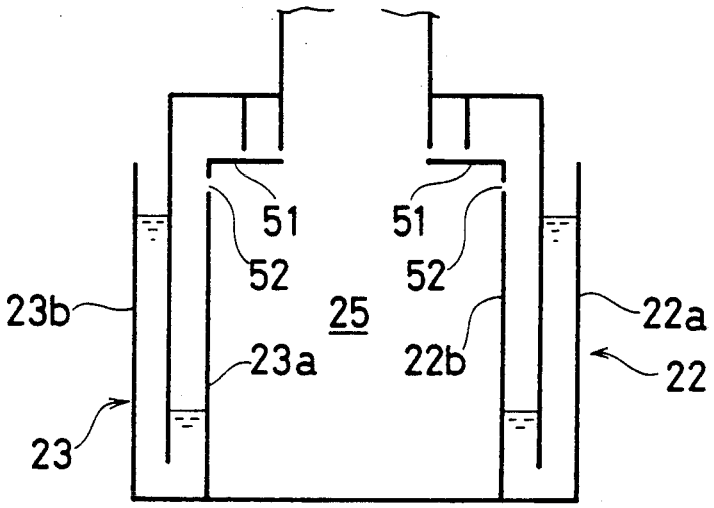
FIG. 6 is a schematic sectional view showing a portion of a cooling apparatus for bulk material representing another embodiment of the invention.

FIG. 6 shows a modified embodiment of the invention. In this embodiment, fifth seal plates 51 are disposed, for example, at same height as the third seal plates 46 so that the communication gaps a are reduced to the narrowest possible extent over the entire length of the travel path A. At other portions of the cooling region C than the heat recovering section D, the inner and outer plates **22*b*, 23*a* of the stationary annular air duct 21 are formed with air holes 52 so that cooling air within the stationary annular air duct 21 which is sufficiently cool is fed into the annular water seal chambers 24** for cooling the water-sealing water at the heat recovering section D.

Figure 7:
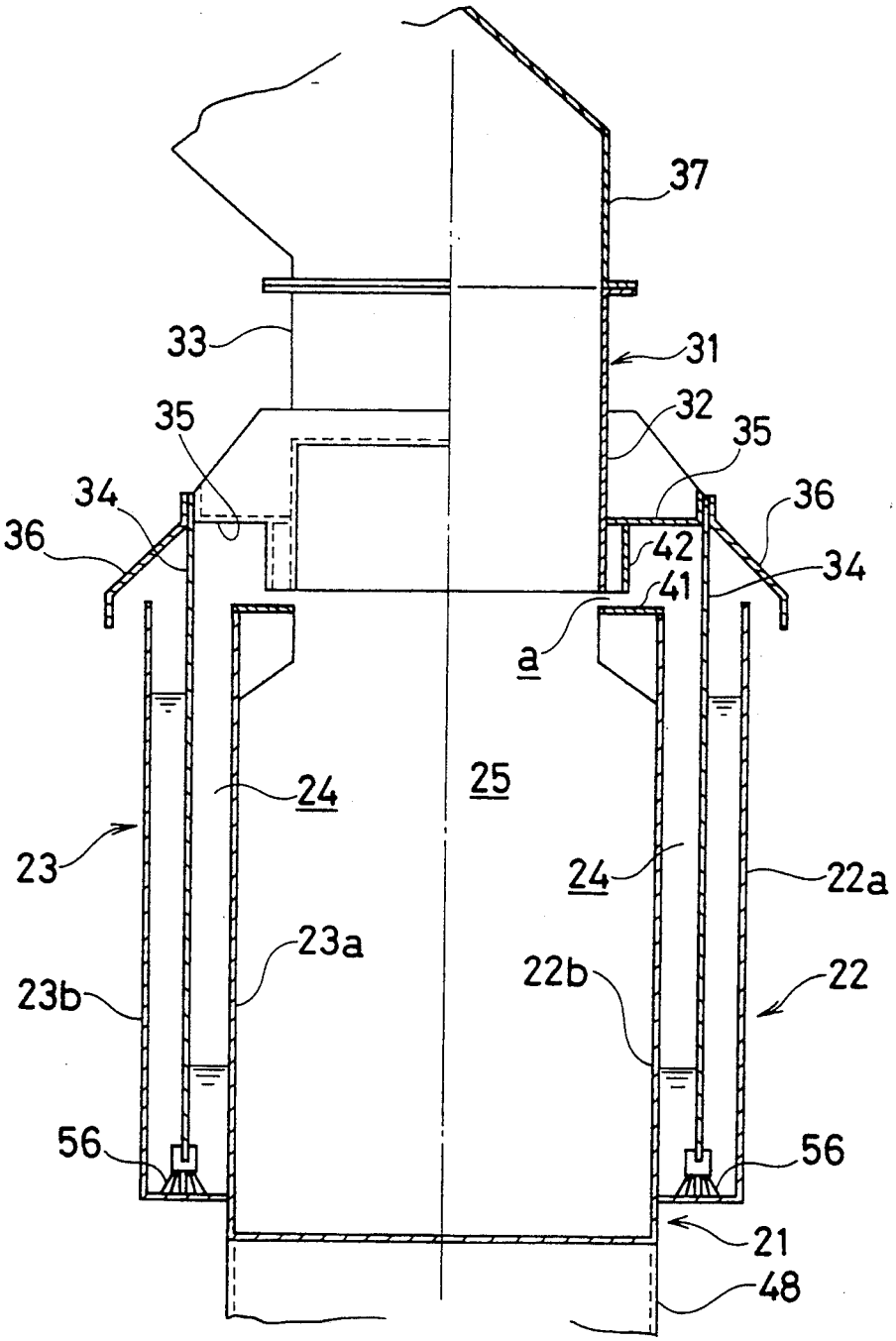
FIG. 7 is a partially cutaway view of a portion of a cooling apparatus for bulk material representing still another embodiment of the invention.

FIG. 7 shows another modified embodiment of the invention. In this embodiment, the seal plates 34 in the annular water seal chambers 24 have stainless steel made wire brushes 56 attached to their respective lower ends under water. The wire brushes 56 are adapted to move integrally with the carrier assembly 1 as the latter moves, whereby they can scrape up dust deposited on the bottom of the annular water seal chambers. A funnel-shaped deposit removal port not shown is provided at the bottom of each of the annular water seal chambers 24 at least at one circumferential location.

According to this arrangement, a part of the dust which has entered the air passage 25 may enter the annular water seal chambers 24 and precipitate and deposit at the bottom thereof, but it can be scraped up by the wire brushes 56 toward respective removal ports. The dust so scraped up can easily be removed by means of a discharge pipe connected to each removal port. Scraping up of dust by such wire brush 56 to each removal port is advantageous in that it is unnecessary to provide a large number of removal ports at the bottom of each annular water seal chamber 24.

A rubber plate or the like may be utilized as a scraper instead of above said wire brush 56. It is also possible to dispose scrapers in a plurality of rows at one location to obtain improved scraping-up effect.

What is claimed is:

1. A cooling apparatus for bulk material wherein masses of hot bulk material loaded on a plurality of troughs movable along a circular travel path are cooled by cooling air supplied from air boxes positioned below respective surfaces on which the masses of hot bulk material are placed, said cooling apparatus comprising:

a stationary annular air duct arranged in a circular fashion along said travel path and having an inner side wall portion located on the inner peripheral side and an outer side wall portion located on the outer peripheral side, said inner and outer side wall portions defining an air passage therebetween, said stationary annular air duct being open at the top;

annular water seal chambers provided on respective outer sides of said inner and outer side wall portions;

a movable annular air duct movable integrally with said troughs and capable of covering the opening of said stationary annular air duct from above, said movable annular air duct having an inner peripheral side wall portion and an outer peripheral side wall portion, said side wall portions having their respective lower ends positioned in corresponding relation to respective upper ends of the inner and outer side wall portions of said stationary annular air duct;

a plurality of connecting ducts for communicating the movable annular air duct with respective air boxes of said troughs;

seal plate members depending respectively from the two side wall portions of said movable annular air duct for entry into the water in said annular water seal chambers;

gaps defined between respective lower ends of the side wall portions of said movable annular air duct and respective upper ends of the side wall portions of said stationary annular air duct which communicate the air passage within the stationary annular air duct with said annular water seal chambers;

first seal plates provided at respective upper ends of the side wall portions of said stationary annular air duct in relation to respective lower ends of the side wall portions of said movable annular air duct so as to minimize said gaps; and second seal plates provided at respective lower ends of the side wall portions of said movable annular air duct to form labyrinth seals in cooperation with said first seal plates.

2. A cooling apparatus for bulk material as set forth in claim 1, wherein the travel path has a heat recovery section in a portion thereof, in which heat recovery section the gaps are defined narrower than those in other portions of the travel path.

3. A cooling apparatus for bulk material as set forth in claim 1, wherein the stationary annular air duct and the movable annular air duct are both disposed at levels lower than the troughs.

4. A cooling apparatus for bulk material as set forth in claim 1, wherein each seal plate member has at the lower end thereof means for scraping up deposits accumulated on the bottom of the annular water seal chamber along with the movement of the movable annular air duct.

5. A cooling apparatus for bulk material wherein masses of hot bulk material loaded on a plurality of troughs movable along a circular travel path are cooled by cooling air supplied from air boxes positioned below respective surfaces on which the masses of hot bulk material are placed, said cooling apparatus comprising:

a stationary annular air duct arranged in a circular fashion along said travel path and having an inner side wall portion located on the inner peripheral side and an outer side wall portion located on the outer peripheral side, said inner and outer side wall portions defining an air passage therebetween, said stationary annular air duct being open at the top;

annular water seal chambers provided on respective outer sides of said inner and outer side wall portions;

a movable annular air duct movable integrally with said troughs and capable of covering the opening of said stationary annular air duct from above, said movable annular air duct having an inner peripheral side wall portion and an outer peripheral side wall portion, said side wall portions having their respective lower ends positioned in corresponding relation to respective upper ends of the inner and outer side wall portions of said stationary annular air duct;

a plurality of connecting ducts for communicating the movable annular air duct with respective air boxes of said troughs;

seal plate members depending respectively from the two side wall portions of said movable annular air duct for entry into the water in said annular water seal chambers;

gaps defined between respective lower ends of the side wall portions of said movable annular air duct and respective upper ends of the side wall portions of said stationary annular air duct which communicate the air passage within the stationary annular air duct with said annular water seal chambers;

seal plate means for reducing said gaps to the narrowest possible extent;

said travel path having a heat recovery section in a portion thereof; and said stationary annular air duct having, at other portions thereof than said heat recovery section, air hole means for communicating the air passage with the annular water seal chambers.

* * * * *